US006460790B1

(12) United States Patent
Wu Huang

(10) Patent No.: US 6,460,790 B1
(45) Date of Patent: Oct. 8, 2002

(54) FRAME WIDTH ADJUSTING STRUCTURE OF PAPER SHREDDER

(76) Inventor: Li-Ming Wu Huang, 3F, No. 29, Lane 80, Sec. 1, Dwu Hwu S. Rd., Taipei (TW)

( * ) Notice: Subject to any disclaimer, the term of this patent is extended or adjusted under 35 U.S.C. 154(b) by 0 days.

(21) Appl. No.: 09/887,163

(22) Filed: Jun. 25, 2001

(51) Int. Cl.[7] ..... B02C 18/16
(52) U.S. Cl. ..... 241/100; 241/236; 241/285.2
(58) Field of Search ..... 241/100, 236, 241/285.2, 301; D18/34; 248/213.2, 685

(56) References Cited

U.S. PATENT DOCUMENTS

| | | | | |
|---|---|---|---|---|
| 3,724,766 | A | 4/1973 | Bosland | 241/100 |
| 4,637,560 | A | 1/1987 | Goldhammer | 241/100 |
| 4,973,004 | A | 11/1990 | Krause et al. | 241/100 |
| D375,973 | S | 11/1996 | Kennedy et al. | 241/100 |
| 5,839,675 | A | 11/1998 | Henreckson et al. | 241/100 |
| 5,988,542 | A | 11/1999 | Henreckson et al. | 241/100 |

*Primary Examiner*—John M. Husar
(74) *Attorney, Agent, or Firm*—Browdy and Neimark, P.L.L.C.

(57) ABSTRACT

The present invention relates to a frame width adjusting structure of the paper shredder and is mounted on a paper shredder main body containing a paper shredding tool, a control circuit, and a drive motor. The main body is provided in one side with a retaining piece extending downwards. The frame width adjusting structure comprises two expandable rods parallel to each other and disposed in other side of the main body to be opposite to the retaining piece; a bridging member connecting the outer ends of the two expandable rods and having a receiving cell with an opening that faces downwards; two fixation pillars disposed at top end sin the top of the receiving cell of the bridging member; two connection rods pivoted with bottom ends of the two fixation pillars; a pull handle provided at the outer end with a retaining piece extending downwards and pivoted with other end of the two connection rods. The user operates the pull handle to swivel in relation to the bridging member to cooperate with a variety of paper strip collectors having openings of various shapes, thereby enabling the paper shredder to be mounted across the paper strip collectors.

3 Claims, 6 Drawing Sheets

FRAME WIDTH ADJUSTING STRUCTURE OF PAPER SHREDDER

FIELD OF THE INVENTION

The present invention relates generally to a paper shredder, and more particularly to a structure for adjusting width of the frame of the paper shredder.

BACKGROUND OF THE INVENTION

The U.S. Pat. No. 5,839,675 discloses a paper shredder as shown in FIG. 1. This prior art paper shredder 70 is provided in one side with an expandable frame 71 which is formed of two expandable rods 72 and an actuate outer rod 75. The two expandable rods 72 are expendably disposed in the main body of the paper shredder 70. The actuate outer rod 75 is fastened with the outer ends of the two expandable rods such that the actuate outer rod 75 cooperates by means of its radian with the actuate fringe of a paper strip collecting bucket 79. In light of the adjustable length of the expandable rods 72, the paper shredder 70 cooperates with the paper strip collecting buckets 79 various in width.

Such a prior art paper shredder as described above is defective in design in that the actuate outer rod 75 has a fixed shape and a fixed radian. As a result, the actuate outer rod 75 can only accommodate a bucket which has an opening of a predetermined radian. In addition, there is lack of a means to fasten the paper shredder 70 with the bucket 79.

SUMMARY OF THE INVENTION

The primary objective of the present invention is to provide a paper shredder with a frame width adjusting structure for adjusting the radian of the outer end of the frame such that the paper shredder cooperates with the paper strip collecting containers having openings various in width and shape. In addition, the paper shredder can be held securely in place on the paper strip collecting containers.

The frame width adjusting structure of the present invention is mounted on the main body of the paper shredder, which is formed of a housing, a paper shredding tool, a control circuit, and a drive motor. The housing is provided in one side with a retaining piece extending downwards. The frame width adjusting structure comprises two expandable rods which are parallel to each other and are expendably disposed in other side of the main body of the paper shredder such that the expandable rods are opposite in location to the retaining piece, and that the outer ends of the two expandable rods are connected by a bridging member which is provided with a receiving cell with an opening facing downwards, two fixation pillars which are disposed at the top end thereof in the top of the receiving cell of the bridging member such that the two fixation pillars are separated from each other by a predetermined distance, and that the bottom ends of the pillars are jutted out of the receiving cell, two connection rods pivoted at one end thereof with the bottom ends of the two fixation pillars, a pull handle provided with a retaining piece extending downwards and pivoted with other ends of the two connection rods. The pull handle is located at the outer side of the bridging member. As the pull handle is swiveled in relation to the bridging member, a small adjustment space is made available to accommodate the paper strip collectors with openings various in shape. The paper shredder is secured in place on the paper strip collector.

DETAILED DESCRIPTION OF THE INVENTION

Figure 1:
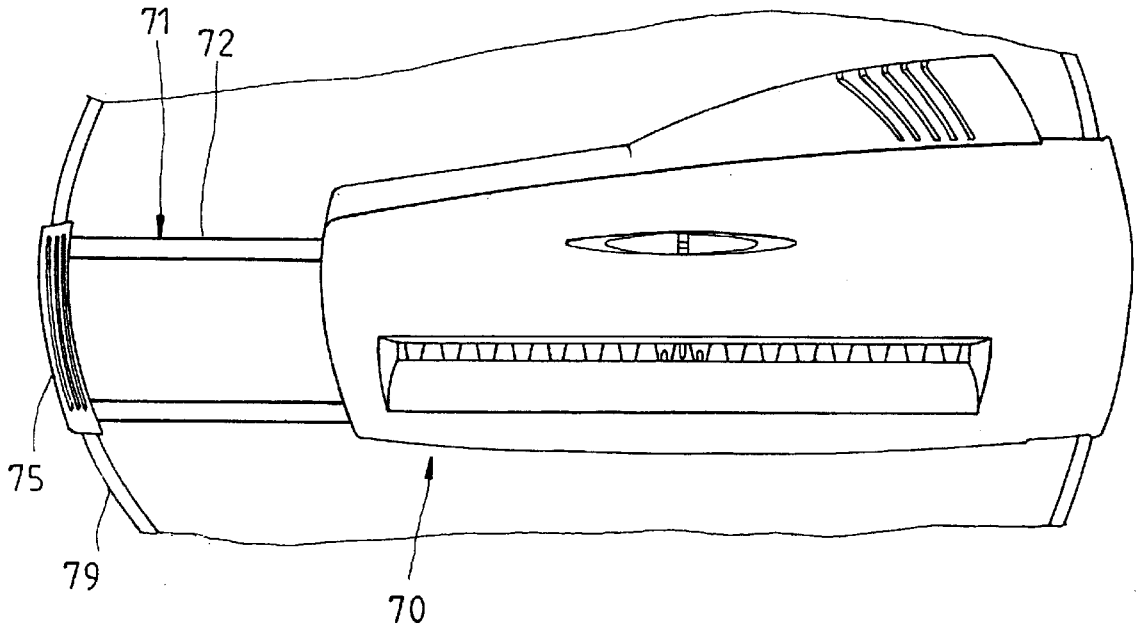
FIG. 1 PRIOR ART
FIG. 1 shows a top view of a paper shredder of the prior art.
Figure 2:
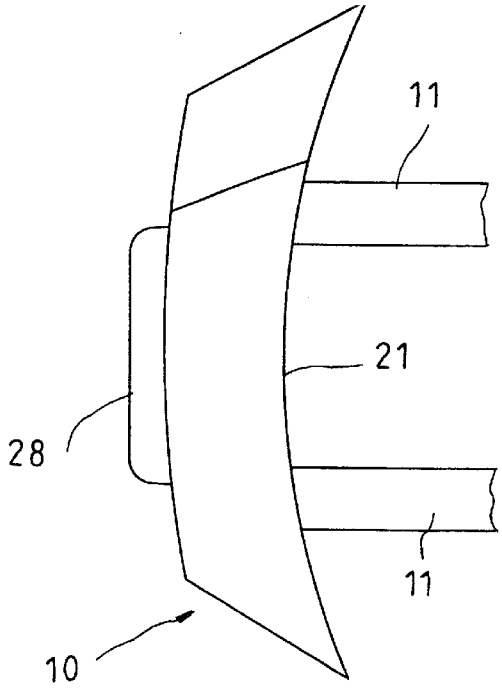
FIG. 2 shows a top view of a preferred embodiment of the present invention.
Figure 3:
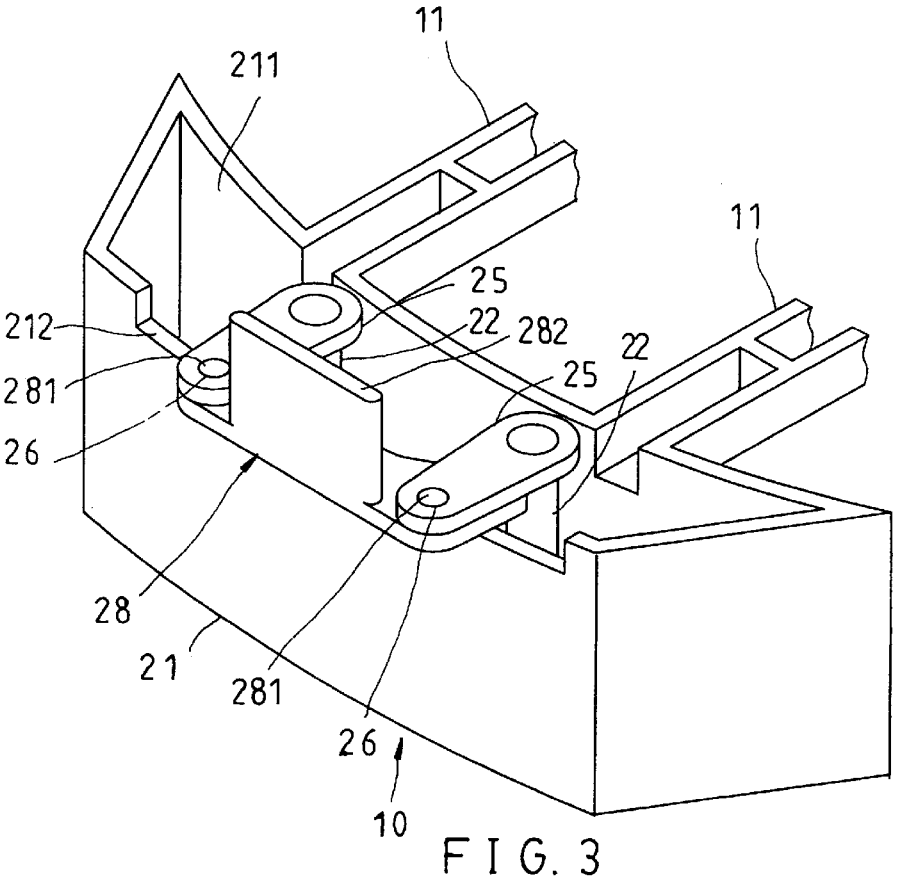
FIG. 3 shows a bottom view of the preferred embodiment of the present invention.
Figure 4A:
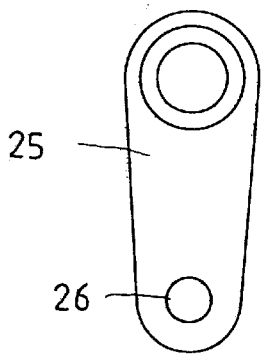
FIGS. 4(A) and (B) shows front view and sectional view of the connection rods of the preferred embodiment of the present invention.
Figure 4B:
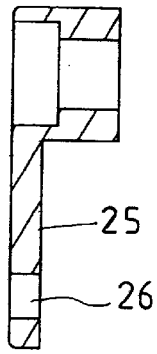
Figure 5A:
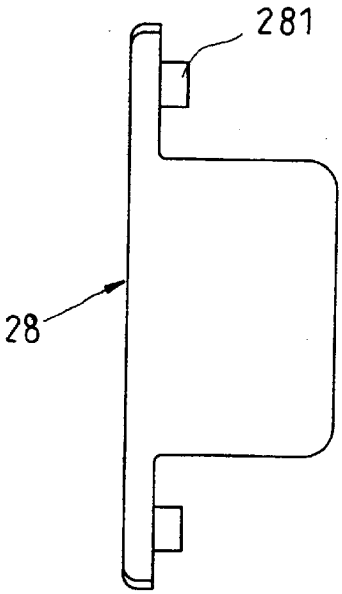
FIG. 5 shows front view, bottom view and left view of the pull handle of the preferred embodiment of the present invention.
Figure 5B:
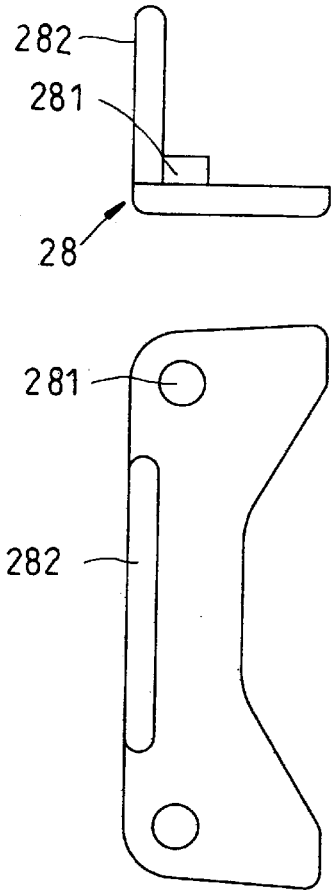
Figure 6:
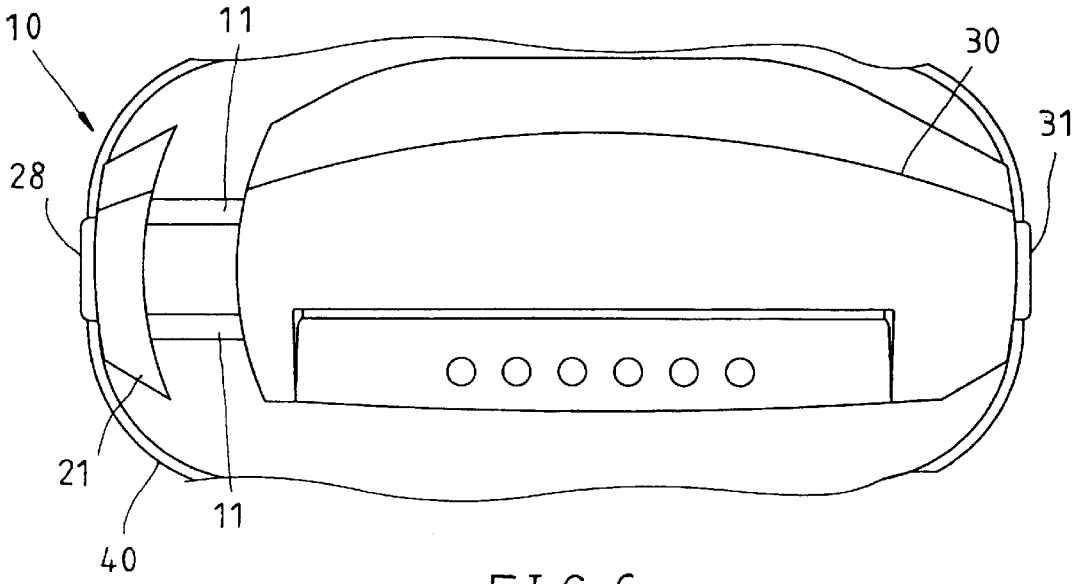
FIG. 6 s schematic view of the preferred embodiment of the present invention in use.

As shown in FIGS. 2–5, a frame width adjusting structure 10 of the preferred embodiment of the present invention is designed for use in a paper shredder such that the structure 10 is mounted on a main body 30 of the paper shredder. The main body 30 contains a paper shredding tool, a control circuit, and a motor, which are not the subject matters of the present invention. The main body 30 is provided in one side with a retaining piece 31 extending downwards, as shown in FIG. 6.

The structure 10 of the present invention comprises two expandable rods 11, a bridging member 21, two fixation pillars 22, two connection rods 25, and a pull handle 28.

The two expandable rods 11 are parallel to each other and are disposed in other side of the main body 30 such that the expandable rods 11 are opposite in location to the retaining piece.

The bridging member 21 connects the outer ends of the two expandable rods 11.

The features of the present invention are described hereinafter.

The bridging member 21 is provided with a receiving cell 211 with an opening which faces downwards. The bridging member 21 is provided in the bottom of the outer side wall with a recessed portion 212.

The two fixation pillars 22 are disposed at top ends thereof in the top of the receiving cell 211 of the bridging member 21 such that the two fixation pillars 22 are separated from each other by a distance, and that the bottom ends of the fixation pillars 22 are jutted out of the receiving cell 211.

The two connection rods 25 are pivoted at one end with the bottom end of the two fixation pillars 22 and are provided at other end with a through hole 26.

The pull handle 28 is provided at the bottom with two projections 281, and in the outer end with a retaining piece 282 extending downwards. The two connection rods 25 are pivoted at the through holes 26 thereof with the two projections 281 such that the space pattern of the two connection rods 25 is such that they are jutted out of the bridging member 21 from the receiving cell 211 and via the recessed portion 212. The pull handle 28 is located at the outer side of the bridging member.

As the pull handle 28 is swiveled in relation to the bridging member 21, a small adjustment space is made available to cooperate with the paper strip collectors various in shape of opening thereof, thereby enabling the paper shredder to be secured in place on the paper strip collectors. The pull handle 28 is swiveled in such a way that two sides of the recessed portion 212 become dead points. In other words, when the pull handle 28 is swiveled toward one side, the connection rods 25 swivel a predetermined angle and then come in contact with the side edge of the recessed portion 212, thereby resulting in formation of a stop point. As a result, the pull handle 28 is stopped at the stop point at the time when the pull handle 28 is swiveled in either direction.

Figure 7A:
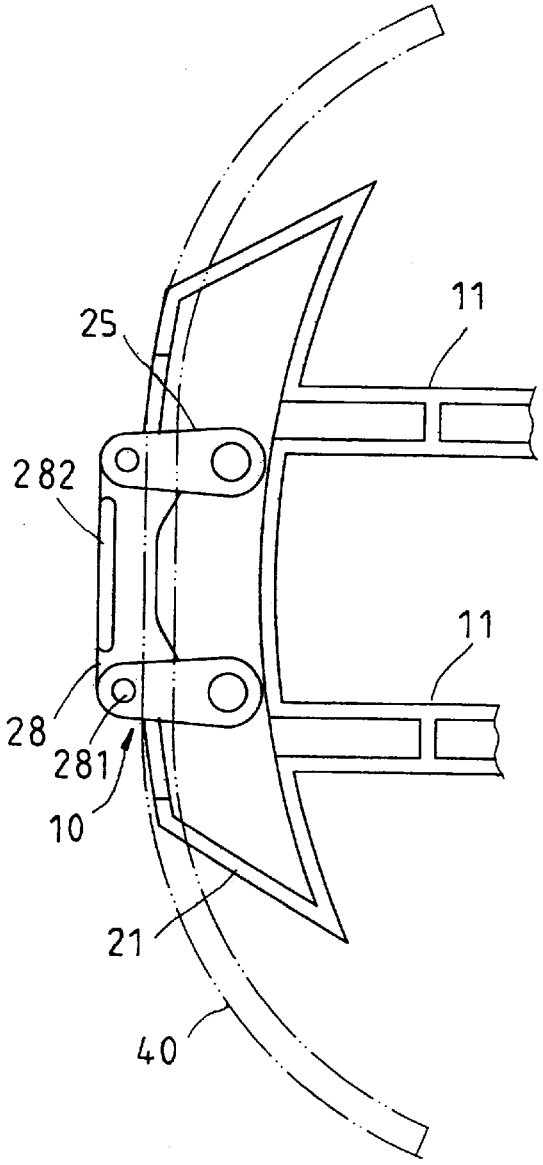
FIGS. 7(A) and (B) shows a schematic view of the preferred embodiment of the present invention in action.
Figure 7B:
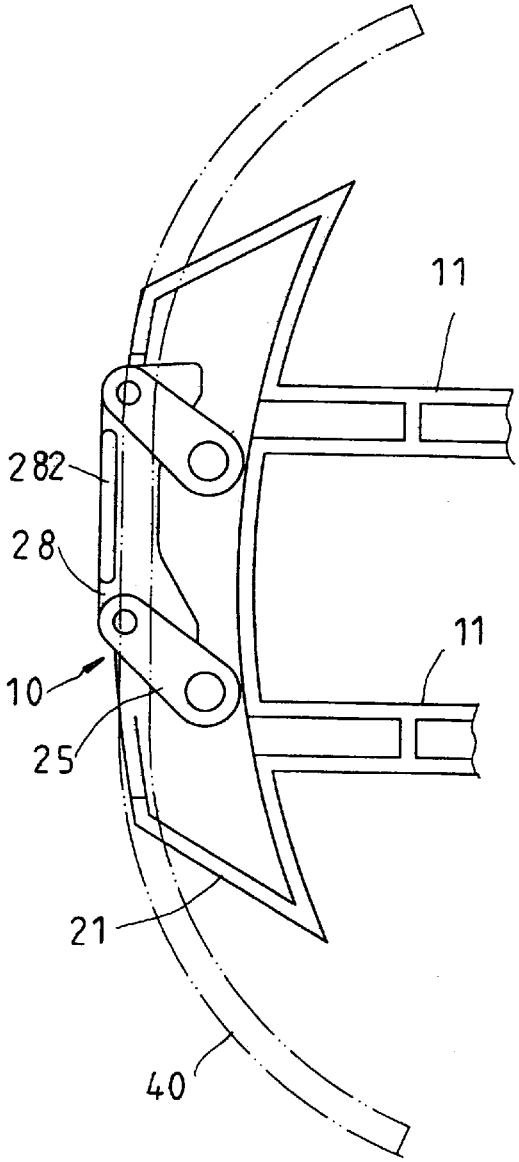
Figure 8A:
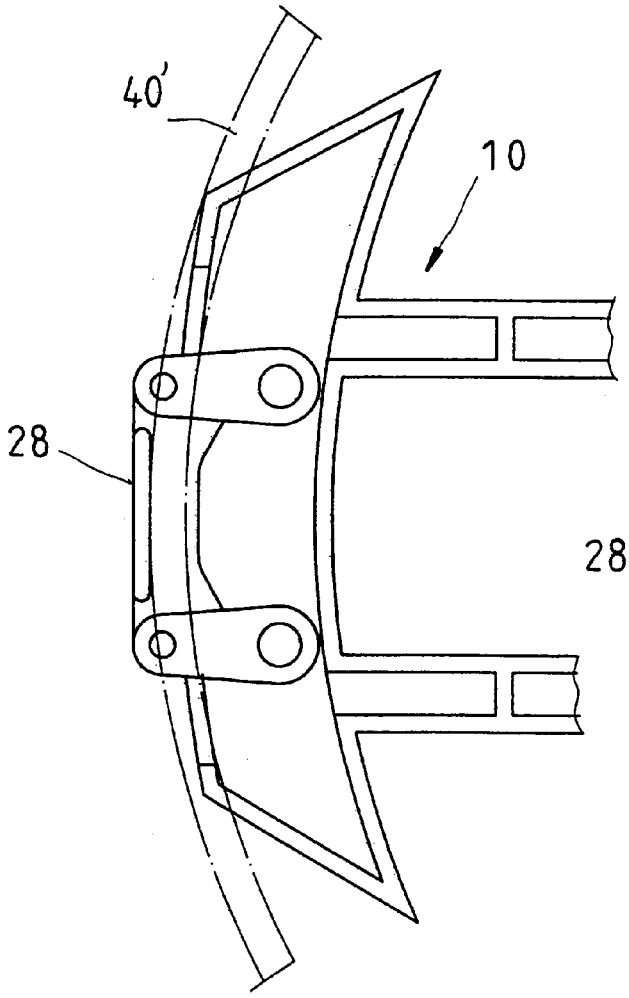
FIGS. 8(A) and (B) shows another schematic view of the preferred embodiment of the present invention in use.
Figure 8B:
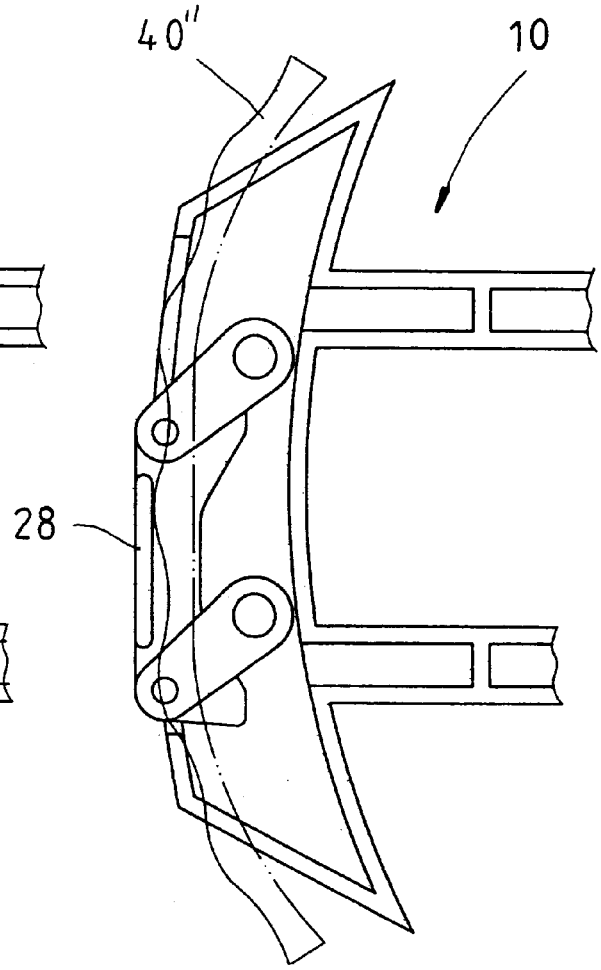

As shown in FIG. 6, the present invention is in use such that the bridging member 21 is held with hand to pull the expandable rods 11 to expand in relation to the main body 30, so as to adjust the frame width of the paper shredder to mount the paper shredder on a paper strip collector 40 which has an opening shape identical with the radian of the bridging member 21. There is no need to adjust again the pull handle 28. If the opening shape of the collector 40 is different from the radian of the bridging member 21, as shown in FIG. 7, the pull handle 28 is swiveled in one direction so as to attain a minute adjustment in position of the retaining piece 282 of the pull handle 28, thereby enabling the retaining piece to come in contact with the outer edge of the opening of the collector 40. The present invention is designed to adapt to the paper strip collectors of various shapes, as shown in FIG. 8. FIG. 8A shows that the present invention 10 cooperates with a collector 40' having a round opening. FIG. 8B shows that the present invention 10 cooperates with a collector 40" having a wavy opening. The pull handle 28 is swiveled in the direction opposite to other direction as shown in FIG. 7.

Figure 9:
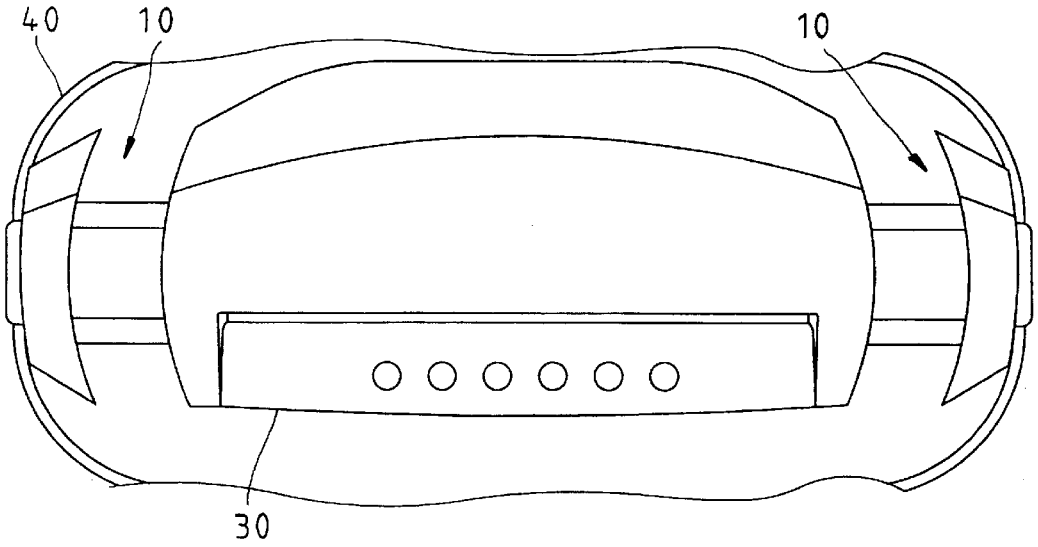
FIG. 9 shows another disposition state reference view of the preferred embodiment of the present invention.

As shown in FIG. 9, the present invention is disposed in two sides of the main body 30 such that the present invention is mounted across the paper strip collector 40. In other words, the installation of the present invention is not confined to one side of the main body 30.

As the pull handle 28 of the present invention is adjusted in its swivel position, the collector 40 is held securely by the retaining pieces 31, 282, at the time when the main body 30 of the shredder is mounted across the collector 40. In light of the swiveling characteristic of the pull handle 28, the present invention is capable of cooperating with a variety of paper strip collectors which have openings of various shapes.

What is claimed is:

1. A frame width adjusting structure of a paper shredder being disposed on a main body of the paper shredder, said main body containing a paper shredding tool, a control circuit, and a drive motor, said main body provided in one side with a retaining piece extending downwards, said frame width adjusting structure comprising:

two expandable rods parallel to each other and disposed in other side of said main body such that said expandable rods are opposite to said retaining piece;

a bridging member connecting outer ends of said two expandable rods;

wherein said bridging member is provided with a receiving cell having an opening which faces downwards;

said structure further comprising:

two fixation pillars disposed at top ends in the top of said receiving cell of said bridging member such that said two fixation pillars are separated from each other by a distance, and that bottom ends of said fixation pillars are jutted out of said receiving cell;

two connection rods pivoted at one end with bottom end of said fixation pillars;

a pull handle provided at an outer end with a retaining piece extending downwards and pivoted with other end of said two connection rods, said pull handle being located at the outer side of said bridging member;

said pull handle being swiveled in relation to said bridging member to bring about a minute adjustment space to cooperate with a variety of paper strip collectors having openings of various shapes, thereby enabling the paper shredder to be mounted across the paper strip collectors.

2. The structure as defined in claim 1, wherein said pull handle is provided in the bottom with two projections, wherein each of said connection rods is provided at the outer end with a through hole which is pivoted with said projection.

3. The structure as defined in claim 1, wherein said bridging member is provided at bottom of the outer side wall with a recessed portion, said pull handle and said two connection rods being located in the outside of said bridging member in such a manner that said two fixation pillars are extended through said recessed portion.

* * * * *